US010654261B2

(12) United States Patent
Brett

(10) Patent No.: US 10,654,261 B2
(45) Date of Patent: May 19, 2020

(54) SYSTEM AND METHOD FOR POSITIONING A PLURALITY OF OBJECTS FOR MULTI-SIDED PROCESSING

(71) Applicant: Kenton F. Brett, Indianapolis, IN (US)

(72) Inventor: Kenton F. Brett, Indianapolis, IN (US)

( * ) Notice: Subject to any disclaimer, the term of this patent is extended or adjusted under 35 U.S.C. 154(b) by 731 days.

(21) Appl. No.: 15/262,173

(22) Filed: Sep. 12, 2016

(65) Prior Publication Data

US 2017/0073163 A1 Mar. 16, 2017

Related U.S. Application Data

(60) Provisional application No. 62/217,514, filed on Sep. 11, 2015.

(51) Int. Cl.

| | |
|---|---|
| ***B41F 17/14*** | (2006.01) |
| ***B41J 3/407*** | (2006.01) |
| ***B41F 17/30*** | (2006.01) |

(52) U.S. Cl.

CPC ..... *B41F 17/14* (2013.01); *B41F 17/30* (2013.01); *B41J 3/4073* (2013.01)

(58) Field of Classification Search

CPC ... B41J 2/01; B41J 3/4073; B41J 23/00; B41J 11/20; B41J 2/14; B41F 14/14

See application file for complete search history.

(56) References Cited

U.S. PATENT DOCUMENTS

| | | | | |
|---|---|---|---|---|
| 5,207,153 | A | 5/1993 | Thomason | |
| 6,923,115 | B1 | 8/2005 | Litscher et al. | |
| 10,104,873 | B2 * | 10/2018 | Elferink | A01K 43/00 |
| 2005/0104241 | A1 | 5/2005 | Kritchman et al. | |
| 2009/0256897 | A1 | 10/2009 | Polk | |
| 2010/0186610 | A1 | 7/2010 | Polk | |

(Continued)

FOREIGN PATENT DOCUMENTS

| | | | |
|---|---|---|---|
| EP | 2851199 | A1 | 3/2015 |
| WO | 2007085825 | A1 | 8/2007 |

OTHER PUBLICATIONS

Partial Supplemental European Search Report for related application EP 16845256.3, dated Feb. 28, 2019.

(Continued)

*Primary Examiner* — Kaitlin S Joerger

(74) *Attorney, Agent, or Firm* — Maginot, Moore & Beck LLP

(57) ABSTRACT

A positioning system for positioning a plurality of rotatable objects for processing includes a base plate that is configured to be positioned on a support surface of a processing machine. The base plate defines a plurality of alignment members to align the base plate to the support surface. The positioning system further includes at least three elongate cylindrical members that are arranged in parallel to one another and rotatably supported in alignment with the base plate. The cylindrical members are configured to support the rotatable objects. The positioning system also includes a rotation mechanism configured to cooperate with the cylindrical members and rotate the cylindrical members in synchrony so as to rotate the plurality of rotatable objects in synchrony. The positioning system further includes a rotational control mechanism configured to cooperate with the rotation mechanism to control rotation of the cylindrical members.

21 Claims, 12 Drawing Sheets

(56) References Cited

U.S. PATENT DOCUMENTS

| | | | | |
|---|---|---|---|---|
| 2016/0221328 | A1* | 8/2016 | Till | B41J 3/4073 |
| 2017/0073163 | A1* | 3/2017 | Brett | B41F 17/14 |

OTHER PUBLICATIONS

Direct Color Systems, "Custom Bottle Printing is Easier Than Ever", http://www.directcolorsystems.com/custom-bottle-printing-is-easier-than-ever/, Sep. 18, 2015 (2 pages).
IDS Digital, "High Speed 360° Digital Printing", Revolution 360° Digital Printer, http://www.ids-digital.com/revolution-360-printer/, last accessed on Aug. 29, 2016 (3 pages).
Leek, Bill, "Printing in the Round: UV Cured Cylindrical Printing Offers New Opportunities", https://a-e-mag.com/features/printing-round-uv-cured-cylindrical-printing-offers-new-opportunities, Jul. 1, 2015 (4 pages).
Inkcups Now, "Inkjet Printing on Bottles", Cylinder Printer XR, http://www.inkcups.com/equipment/industrical-uv-inkjet-pringers-cylinder-printer/Default.aspx, last accessed on Aug. 29, 2016 (2 pages).
Mimaki USA, "Kebab option: 360-degree direct printing on cylindrical products", http://www.mimakiusa.com/products/uv/ujf-3042hg-ujf-6042-kebeb-option/, last accessed on Aug. 29, 2016 (3 pages).
International Search Report and Written Opinion, dated Dec. 26, 2016, issued in corresponding application No. PCT/US2016/051258.

* cited by examiner

SYSTEM AND METHOD FOR POSITIONING A PLURALITY OF OBJECTS FOR MULTI-SIDED PROCESSING

This application claims the benefit of U.S. Provisional Application No. 62/217,514, filed Sep. 11, 2015, the entire disclosure of which is herein incorporated by reference.

FIELD

This application relates to the field of positioning systems for objects, and particularly to positioning systems for multi-sided processing of a plurality of rotatable or non-rotatable objects.

BACKGROUND

In art, sport, home, industry and other fields, there are many processes that are applied to round or cylindrical objects, or approximately round or cylindrical, such as octagonal or oval, where a fixture is needed to hold the objects in place for the process. Sometimes the process is to be applied to two or more sides of the objects, requiring the objects to be rotated before further processing is possible. For example, objects can be treated with light, chemicals or radiation, or the objects can be painted, washed, inspected, printed, etched, photographed, or any of several other processes.

As a specific example, modern printers, such as ultraviolet (UV) ink jet printers, are often used to print on the curved surfaces of objects, such as printing a company logo on the curved surfaces of ink pens. Typically, the multi-sided printing of objects in small batch jobs requires the objects to be placed in custom foam-board fixtures that are designed and built for each specific type of object or product. Many of these jobs are done on small UV ink jet printers with high gantries (HG) and printable areas in the range of 1 to 3 square feet, although any size flatbed can be used as long as the product fits under the gantry.

Such printers are excellent for printing on round or cylindrical objects, including markers, batteries, collets, corks, test tubes, flashlights, lipstick and lip balm tubes, lasers and pointers, pencils and pens, nail polish and perfume bottles, wedding and party favors, ear plugs and their cases, chalk, confetti tubes, mascara, shot glasses and mini liquor bottles, mini telescopes and monoculars, lighters, cigars, e-cigarettes, super balls, golf balls, ping pong balls, candy tubes and candy rolls, thimbles, erasers, balms, bath salts and other bath products, candles and candle holders, jewelry, electronics such as capacitors, transistors, fuses, diodes, mini power banks, USB ports and chargers, etc., many types of containers, mechanical parts, models, samples, displays and promotional items of all sorts and sizes.

The fixtures commonly used for printing such objects are customized for a specific product by cutting out shapes in a board, often foam board, so the individual items can be secured in the respective cutouts in the board during printing thereon. Since various objects can have a variety of different diameters and shapes, a print shop needs many different fixtures to be constructed. The procurement of multiple, custom fixtures can be expensive, time consuming, and require substantial organization and storage space. Accordingly, there exists a need for a single fixture that accommodates many different sizes and shapes of objects.

Furthermore, many objects are printed on two or more sides, requiring the operator to manually remove the object from the fixture, turn the object, and then reinsert the object into the fixture for the processing of each side. Commonly used fixtures do not allow for quick, easy, and precise synchronous turning of multiple objects for multi-sided printing. For example, to print a company logo on two sides of a lipstick case, the case is manually removed from the fixture after the first printing, flipped over or rotated, and then placed back in the fixture for the second printing. With numerous objects in a fixture, this manual procedure is time consuming and there is no straightforward way to ensure that all items are rotated accurately. For instance, if a plurality of objects is to be printed on three sides, the operator may incorrectly estimate the 120° angle to rotate each object, which ultimately results in inconsistent and incorrectly printed objects. In practice, the operator visually determines if the first printed logo appears to be facing the correct position. This visual inspection process is repeated for each object. However, if many objects are to be printed on multiple sides, this visual-manual turning process becomes very inefficient and prone to error. Consequently, there exists a need for an apparatus and a method to synchronously turn the objects in a way that enables the process to be conducted correctly and efficiently.

In the field of ink jet printers, motorized fixtures are sometimes used to rotate a large cylinder, such as a water bottle or wine bottle, in order to wrap the printing around the entire circumference or a portion of the circumference of the cylinder. Such an apparatus and process can be effective for wrap-printing large, cylindrical objects, but such an apparatus and process is highly inefficient for other jobs, such as printing numerous small round or cylindrical objects on multiple sides.

Another type of motorized fixture known in the printing industry is sometimes used to print cell phone cases on the back and on the two long edges without removing the cases from the fixture. While these fixtures may be effective for their intended purpose, such fixtures are ineffective for other jobs, such as printing numerous small round or cylindrical objects on multiple sides. To print numerous round or cylindrical objects using such a fixture, each of the objects would need to be individually attached to the fixture and then manually removed and reattached if printing were needed on the bottom side (or opposite side). In addition, each internal fixture would need to be redesigned and made to custom fit each object. Accordingly, there exists a further need for an apparatus and a method for quickly and easily placing multiple small objects, such as dozens, hundreds, or thousands of objects, depending on their respective sizes, onto a single fixture that easily and synchronously rotates all of the objects to a new, easily identifiable position for additional processing on another side of the objects.

Many machines use zero coordinate methods to establish alignment between the machine and the media to be worked. For example, the machines may shine a thin light beam to display the 0, 0 coordinates on the media to be processed. Multiple coordinate checks may be involved, often using a computer interface, which is daunting and time consuming, especially for first time users studying the lengthy operator manuals. While these methods may serve their purpose for certain applications, they are not typically useful in establishing alignment for numerous items to be worked at once, especially if the items are not uniform in size or shape. For example, if a plurality of elongate objects is to be printed near one end, but not the other end, the zero coordinate methods cannot ensure correct alignment because the objects could be accidentally placed backwards. Therefore, an apparatus and method is needed to ensure quick and reliable alignment of machines to multiple media to be worked.

Some printers that use zero coordinate beams do not provide for alignment of all objects to print. These machines may instead use plates to perform test drawings, but as their instructions indicate, this alignment method is intended to check for "drawing defects" caused by nozzle clogging, low ink supply, or other issues with the machine. While such alignment methods may serve that stated purpose, these methods are not intended for the purpose of checking alignment of the print with the product and cannot be used for that purpose since the plate and test media are opaque. Consequently, there exists a need for an apparatus and method to ensure correct alignment of the printer with all objects to be printed. There further exists a need for a software template that enables quick and easy placement of artwork or other process instructions at the correct positions to ensure desired outcomes.

While a process is being performed on a batch of objects, the operator may have idle time, yet when the operator is loading and unloading a fixture, the machine itself may have idle time. To maximize efficiency, there exists a need to organize the work in such a way as to minimize idle time. A duplicate fixture may be procured for loading during processing on the original fixture. This duplicate fixture is then switched when processing on the original fixture is complete. However, this strategy doubles the number of fixtures to be built, purchased, stored, and organized. Furthermore, such switching of fixtures requires a realignment process each time one of the fixtures is installed onto the printer bed. Accordingly, there exists a need for a multipurpose auxiliary fixture or tray that holds round or spherical objects of many different sizes, which can be loaded during the machine process, either manually or with an automated method, in preparation to quickly and efficiently transfer the objects from the auxiliary fixture to the primary fixture when the machine process has been completed.

Once the machine process is complete, the processed round or cylindrical objects must be removed from the primary fixture before new objects are placed thereon for the next batch. A typical removal method involves hand-picking each object from the fixture and placing it elsewhere. However, with numerous objects on the fixture, this manual, one-by-one removal method is very time-consuming. Accordingly, there exists a need for an apparatus and method configured to simultaneously extract all of the objects from the fixture in one continuous motion.

Furthermore, there are many processes that are applied to non-round, non-cylindrical objects in batches, where a fixture is needed to hold the objects in place for the process. Sometimes the process is to be applied to two or more sides of the objects, requiring the objects to be repositioned in some manner before further processing is possible. For example, to print on magnets, lighters, spoons, gift boxes, or iPhone covers, a custom fixture is typically made for each object to hold multiples of the item in place for printing. Accordingly, there exists a need for a single fixture that can easily align and releasably secure such non-round, non-cylindrical objects for multi-sided processing.

SUMMARY

A positioning system in one embodiment positions a plurality of rotatable objects for processing. The positioning system includes a base plate configured to be positioned on a support surface of a processing machine, the base plate defining a plurality of alignment members for aligning the base plate to the support surface, at least three elongate cylindrical members arranged in parallel to one another and rotatably supported in alignment with the base plate, the cylindrical members configured to support the plurality of rotatable objects, a rotation mechanism configured to cooperate with the cylindrical members and rotate the cylindrical members in synchrony so as to rotate the plurality of rotatable objects in synchrony, and a rotational control mechanism configured to cooperate with the rotation mechanism to control rotation of the cylindrical members.

A positioning system in one embodiment positions a plurality of non-rotatable objects for processing. The positioning system includes a base plate configured to be positioned on a support surface of a processing machine, the base plate having a support surface and defining alignment members for aligning the base plate on the support surface, the support surface having a marking that delineates a processing area of the processing machine, and an adhesive pad disposed on the support surface so as to cover the entire processing area, the adhesive pad having an adhesive strength configured to (i) retain the plurality of non-rotatable objects for printing and (ii) release of the plurality of non-rotatable objects for removal or reorientation after printing.

An alignment apparatus in one embodiment aligns a plurality of objects on a positioning system for processing. The positioning system is disposed on a support surface of a processing machine and configured to support and orient the plurality of objects, the positioning system including a base plate that defines members for aligning the positioning system on the support surface, the alignment apparatus includes a frame configured to hold a transparent support screen, the frame configured to cooperate with the support mechanism such that the transparent support screen is positionable in spaced opposition to the support mechanism, the support screen sized to approximate a processing area of the processing machine, and a sheet of transparent paper supported by the transparent support screen, the transparent paper sized to approximate the processing area and including respective images that correspond to the expected positions of the plurality of objects on the support mechanism.

The above described features and advantages, as well as others, will become more readily apparent to those of ordinary skill in the art by reference to the following detailed description and accompanying drawings. While it would be desirable to provide a positioning system that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
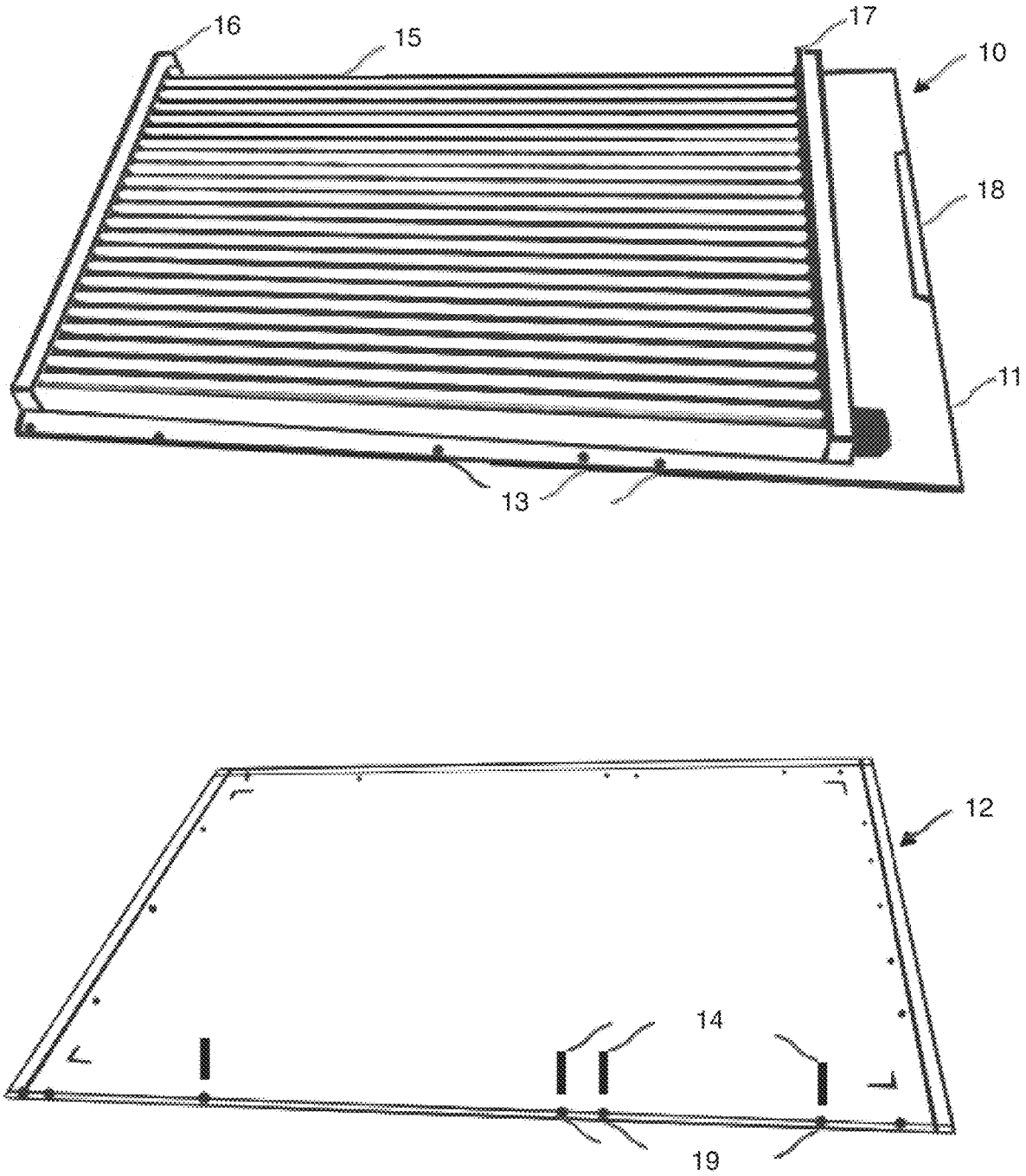
FIG. 1 shows a top perspective view of a support mechanism for positioning a plurality of rotatable objects via a plurality of cylindrical members with the support mechanism shown detached and disposed above a support surface of a processing machine.
Figure 5:
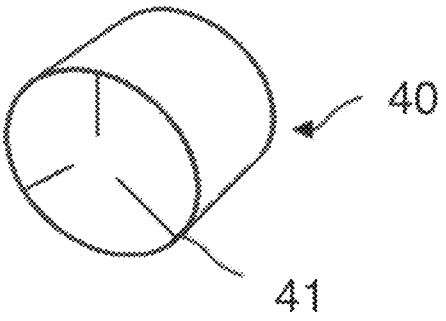
FIG. 5 shows a side perspective view of one of the rotatable objects of FIG. 1 with markings that denote predetermined angular positions of the object.

FIG. 1 depicts a positioning system with an exemplary support mechanism 10 configured to position a plurality of rotatable objects (i.e., rotatable object 40 depicted in FIG. 5) for processing. The term "rotatable objects" includes any object with at least one substantially continuous circumferential surface that enables the object to be rotated with the positioning system about a rotation axis of the object without substantially changing the position of the rotation axis during rotation. Such "rotatable objects" encompass spherical or round objects, cylindrical objects, or objects with portions that are spherical, round, or cylindrical.

The support mechanism 10, sometimes referred to as a mechanical rotisserie, includes a base plate 11 configured to support and align various features of the support mechanism 10 with a support surface 12 of a processing machine, such as a printer bed or table of a printer. The base plate 11 defines alignment members 13 that correspond to alignment members 19 in the support surface 12. The alignment members 13 of the base plate 11 are positioned based on the specifications of the support surface 12. In the embodiment shown, the alignment members 13 of the base plate 11 and the alignment members 19 of the support surface 12 are configured as corresponding holes such that a plurality of pegs, bolts, or the like 14 can be inserted though the respective holes of the base plate 11 and the support surface 12 to correctly position and fix the support mechanism 10 on the support surface 12. In other embodiments, the base plate 11 and the support surface 12 include different alignment features configured to cooperate so as to correctly position and fix the support mechanism 10 on the support surface 12. The base plate 11 in the embodiment shown includes handles 18 to facilitate lifting and placement of the support mechanism 10 although different features can be used in other embodiments to move the support mechanism 10.

The support mechanism 10 further includes a plurality of elongate cylindrical members 15 arranged in parallel to one another and rotatably supported in alignment with the base plate 11. The cylindrical members 15 each have a rotation axis, two opposed axial ends, and a circumferential face that extends between the axial ends. The cylindrical members 15 are positioned side-by-side such that the circumferential faces of adjacent cylindrical members 15 are opposed and the respective rotation axes of the cylindrical members 15 lie in a common plane. In the embodiment shown, the cylindrical members 15 are made of a strong, stiff, yet lightweight material, such as 16 gauge 6061 Aluminum tube. In other embodiments, the cylindrical members 15 are made of other materials. In yet further embodiments, the cylindrical members are configured as solid cylindrical members so as to increase the durability and the weight capacity of the support mechanism 10. As described further below, the cylindrical members 15 are configured to support the rotatable objects 40 for positioning thereof.

The support mechanism 10 further includes a first block 16 and a second block 17 arranged on the base plate 11. The first block 16 and the second block 17 are configured to rotatably support the cylindrical members 15 and align the cylindrical members 15 with the base plate 11. In the embodiment shown in FIG. 1, the first block 16 and the second block 17 are spaced apart from one another and rotatably support the respective axial ends of the cylindrical members 15 such that the cylindrical members 15 are perpendicular to the first and second blocks. In other embodiments, one or more of the first block 16 and the second block 17 translate relative to the base plate 11 and rotatably support the respective circumferential faces of the cylindrical members 15.

The first block 16 in the embodiment of FIG. 1 supports, the cylindrical member 15, holds the cylindrical members 15 in place, and allows the cylindrical members 15 to rotate freely. The second block 17 in the embodiment of FIG. 1 supports the cylindrical members 15, holds the cylindrical members 15 in place, and contains a rotation mechanism 30 (FIG. 3) that rotates the cylindrical members in synchrony as discussed below with reference to FIG. 3. In the embodiment shown, the first block 16 and the second block 17 are made of a low friction material such as DuPont™ Delrin®.

In the embodiment depicted in FIG. 1, each of the cylindrical members 15 has a diameter that is common among all of the cylindrical members 15 of the support mechanism 10. The rotatable objects 40 supported on the support mechanism 10 for processing are each aligned to a respective center template line or position line 61 (FIG. 7) that is defined between adjacent cylindrical members 15. The support mechanism 10 has different numbers of position lines in different embodiments. For instance, a support mechanism with two cylindrical members aligns the rotatable objects 40 along a single position line 61, a support mechanism with three cylindrical members aligns the rotatable objects along two, different position lines 61, and so on. The rotatable objects 40 each contact the adjacent cylindrical members at a first contact interface between the rotatable object 40 and one of the adjacent cylindrical members and at a second contact interface between the rotatable object and the other of the adjacent cylindrical members. The contact between the adjacent cylindrical members 15 and the rotatable object 40 enables the cylindrical members to rotate the object and ensures the rotable object 40 remains in alignment with the corresponding position line 61 defined by the adjacent cylindrical members.

The cylindrical members 15 in the embodiment shown have an axial length that extends beyond a processing area (denoted by rectangle 25 in FIG. 2, rectangle 56 in FIG. 6, and rectangle 63 in FIG. 7) of the processing machine so that the support mechanism 10 can efficiently accommodate longer rotatable objects with surface portions that do not require processing. The support mechanism 10 can also accommodate rotatable objects with large diameters by selective placement of the large-diameter rotatable objects along every other position line 61. For instance, a support mechanism with four cylindrical members defines a first position line between a first and a second cylindrical member, a second position line between the second and a third cylindrical member, and a third position line between the third and a fourth cylindrical member. A first of the large-diameter rotatable objects is placed along the first position line in contact with the first and the second cylindrical members while a second of the large-diameter rotatable objects is placed along the third position line in contact with the third and the fourth cylindrical members. In this example, there is no large-diameter rotatable object placed on the second position line in contact with both the second and the third cylindrical members. In other embodiments, the rotatable objects are placed on the support mechanism in any manner that avoids impeding placement and/or rotation of the objects and that maximizes the efficiency of the processing of the objects by the processing machine.

Figure 3:
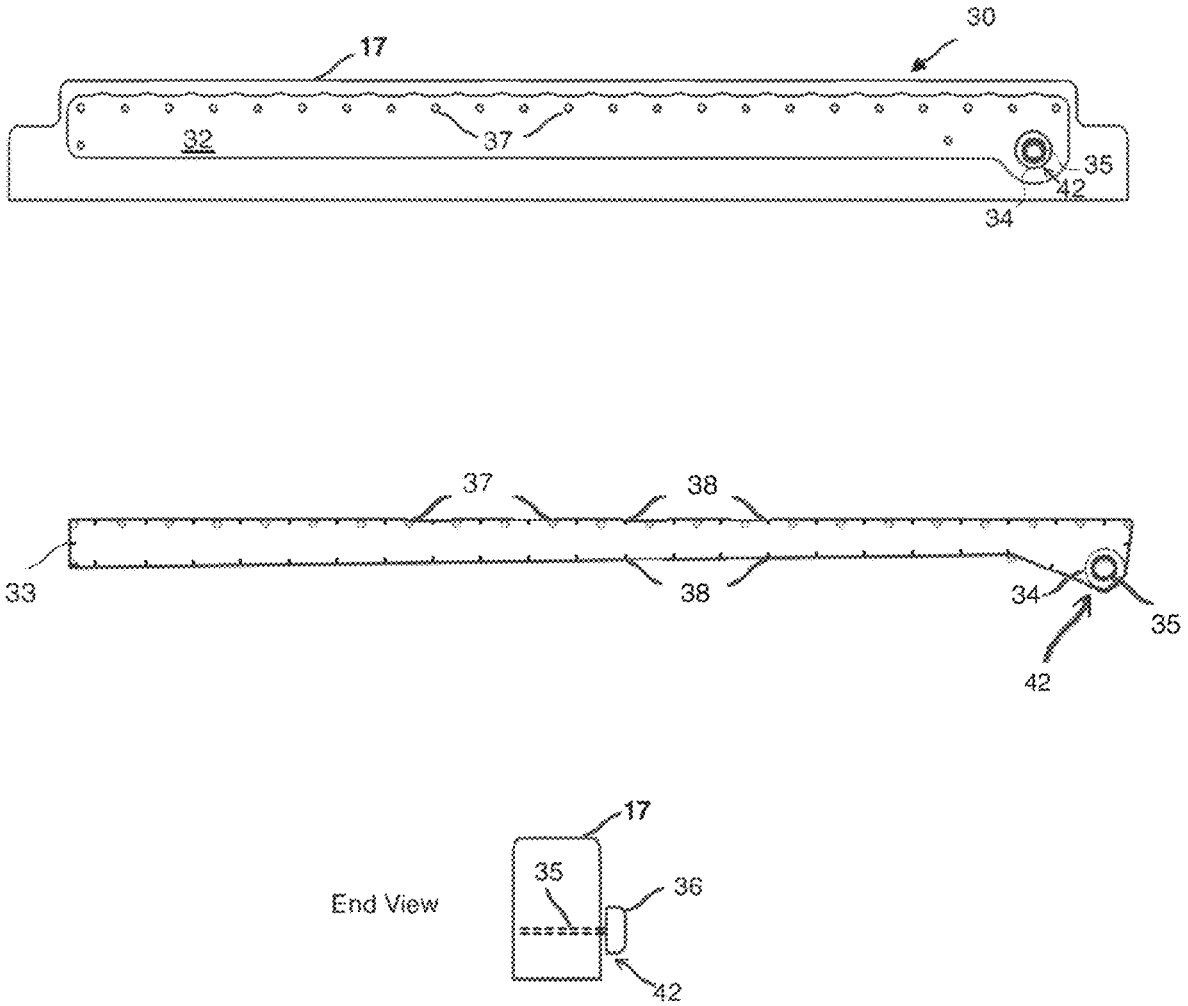
FIG. 3 shows a schematic side view of a low friction block of the support mechanism of FIG. 1 with a rotation mechanism and a rotational control mechanism disposed in the low friction block.
Figure 4:
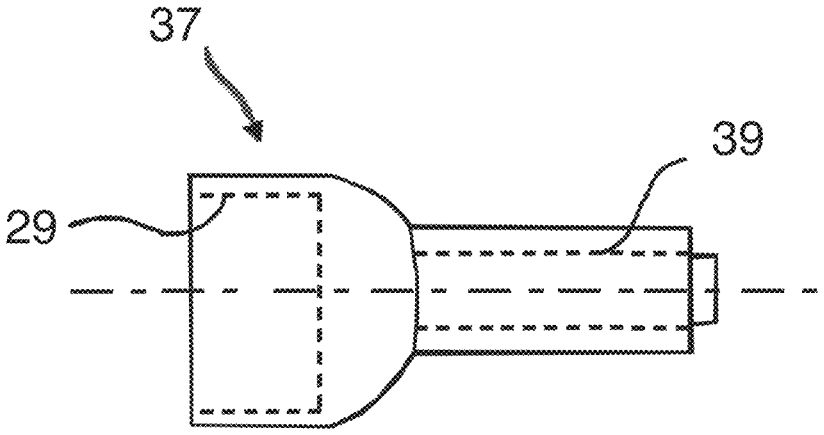
FIG. 4 shows a side plan view of a timing pulley of the rotational control mechanism of FIG. 3.

Referring now to FIGS. 1, 3, and 4, the support mechanism 10 further includes a rotation mechanism 30 configured to cooperate with the cylindrical members 15 and rotate the cylindrical members 15 in synchrony with one another so as to rotate the plurality of rotatable objects in synchrony. In the embodiment shown, the rotation mechanism 30 is positioned substantially within a channel 32 defined by the second block 17 and facing the first block 16. The rotation mechanism 30 includes a drive belt or timing belt 33 that cooperates with a plurality of timing pulleys 37. As best shown in FIG. 3, the timing belt 33 has a plurality of protrusions 38 spaced apart along a periphery of the timing belt 33. As best shown in FIG. 4, the cylindrical members 15 are fixedly attached to corresponding timing pulleys 37 at respective openings 29 defined by each of the timing pulleys 37 for corresponding rotational support of the cylindrical members 15. The timing pulleys 37 each have a plurality of grooves 39 spaced apart along an outer periphery of a portion of the timing pulley. The protrusions 38 of the timing belt 33 are configured to cooperate with the grooves 39 of the respective timing pulleys 37 so that movement of one or more of the timing belt 33 and any one or more of the timing pulleys 37 rotates the cylindrical members 15 in synchrony. In other embodiments, the rotation mechanism includes other features that cooperate with the cylindrical members 15 to rotate the cylindrical members 15 in synchrony.

With reference again to FIG. 3, the support mechanism 10 further includes a rotational control mechanism 42 configured to cooperate with the rotation mechanism 30 to control rotation of the cylindrical members 15. The rotational control mechanism 42 includes a shaft 35 rotatably supported by the second block 17 and a drive pulley 34 fixedly attached to the shaft 35. The drive pulley 34 is configured to cooperate with the timing belt 33 to move the timing belt 33 relative to the timing pulleys 37 when the shaft 35 is rotated. The drive pulley 34 in the embodiment shown has a plurality of grooves that is configured to cooperate with the protrusions 38 of the timing belt 33 so as to move the timing belt 33 when the drive pulley 34 is rotated via the shaft 35.

The rotational control mechanism 42 in a first embodiment further includes a knob 36 configured to be attached to the shaft 35 so as to rotate the shaft 35 when the knob 36 is rotated, for example, by an operator. The operator turns the knob 36, thereby turning the shaft 35 and the drive pulley 34, thereby mechanically driving the timing belt 33 to move through the channel 32 in the second block 31. The tinning belt 33 in turn drives the timing pulleys 37 affixed to the ends of the cylindrical members 15 FIG. 1), thereby rotating the cylindrical members 15 until the operator ceases turn the knob 36. In order to minimize accidental turning, the support mechanism 10 can be configured to impart additional friction to the rotation mechanism 30.

With reference to FIGS. 3 and 4, at least one of the plurality of rotatable objects 40 in this first embodiment includes one or more markings 41 indicative of a predetermined angular displacement as a guide for rotating all of the objects 40 via the knob 36. The marked object 40 is placed nearest the operator so the operator can clearly see the guide marks 41 and rotate the marked object 40 via the knob 36 to the next marked position 41, which in turn rotates all other objects on the support mechanism 10 to the next predetermined position. In an alternative embodiment, a slug or a blank of a diameter equal to the plurality of rotable objects 40 is marked in the same manner as the marked object 40 of FIG. 5 and similarly used as the guide. Such blanks can be very short in axial length to conserve space so as to fit as many rotable objects as possible on the support mechanism 10.

The rotational control mechanism 42 in a variant of the first embodiment further includes a plurality of first template backgrounds respectively configured to be positioned proximate to the knob 36. The first template backgrounds each correspond to a respective common diameter of the plurality of rotatable objects to be processed and have markings that correspond to a plurality of angular displacement groups. The angular displacement groups on a given first template background correspond to different groups of predetermined angular displacements for the rotatable objects on the support mechanism 10. Each angular displacement group includes a group of N markings for use with the knob 36 such that a rotation of the knob 36 between two sequential markings on the first template background within the same angular displacement group corresponds to a synchronous rotation of the rotable objects 40 over the angular displacement indicated by that angular displacement group.

The angular displacement groups in some embodiments can include: (i) a "180° Group" in which the rotatable objects 40 are rotated two times at 180° each rotation to process the entire 360° circumference of the objects; (ii) a "120° Group" in which the rotable objects 40 are rotated three times at 120° each rotation to process the entire 360° circumference of the objects; (iii) a "90° Group" in which the rotatable objects 40 are rotated four times at 90° each rotation to process the entire 360° circumference of the objects; and so on. The angular displacement groups in other embodiments can be configured for processing less than the entire 360° circumference of the objects.

In one example, the first template background is configured for a plurality of one-inch diameter rotatable objects and includes markings for two angular rotation groups: the 180° Group and the 120° Group. The markings for the 180° Group A include two markings appropriately identified on the first template background such that a rotation of a reference marking on the knob 36 from the first marking of the 180° Group to the second marking of the 180° Group correspondingly rotates the rotatable objects 180° on the support mechanism 10. The markings for the 120° Group include three markings appropriately identified on the first template background such that a first rotation of the reference point on the knob 36 from the first marking of the 120° Group to the second marking of the 120° Group correspondingly rotates the rotatable objects 120° on the support mechanism 10. Similarly, a second rotation of the reference point on the knob 36 from the second marking of the 120° Group to the third marking of the 120° Group correspondingly rotates the rotatable objects another 120° on the support mechanism 10. As illustrated in the example, N for each different angular displacement group is different.

The rotational control mechanism 42 in a second embodiment further includes a plurality of interchangeable knobs 36 configured to be attached, respectively, to the shaft 35 so as to rotate the shaft 35 when the attached knob is rotated, for example, by the operator. The interchangeable knobs 36 each correspond to a respective common diameter of the plurality of rotatable objects to be processed.

The interchangeable knobs in a first variant of the second embodiment have markings that correspond to a single angular displacement group, such as the 180° Group or the 120° Group as described above. In one example of this first variant of the second embodiment, a first interchangeable knob is configured for a plurality of one-inch diameter rotatable objects and includes markings for the 180° Group. The markings for the 180° Group A include two markings appropriately identified on the first interchangeable knob such that a rotation of the first interchangeable knob from the first marking of the 180° Group to the second marking of the 180° Group with respect to a reference marking on the support mechanism 10 correspondingly rotates the rotatable objects 180° on the support mechanism 10. In another example of this first variant of the second embodiment, a second interchangeable knob is configured for the plurality of one-inch diameter rotatable objects and includes markings for the 120° Group. The markings for the 120° Group include three markings appropriately identified on the second interchangeable knob such that a first rotation of the second interchangeable knob from the first marking of the 120° Group to the second marking of the 120° Group with respect to the reference marking on the support mechanism 10 correspondingly rotates the rotatable objects a 120° on the support mechanism 10. Similarly, a second rotation of the second interchangeable knob from the second marking of the 120° Group to the third marking of the 120° Group with respect to the reference marking on the support mechanism 10 correspondingly rotates the rotatable objects another 120° on the support mechanism 10.

The interchangeable knobs in a second variant of the second embodiment have markings that correspond to a plurality of angular displacement groups, such as the 180° Group and the 120° Group. In one example of the second variant of the second embodiment, a third interchangeable knob is configured for a plurality of one-inch diameter rotatable objects and includes markings for the 180° Group and the 120°. The markings for the 180° Group include two markings appropriately identified on the third interchangeable knob such that a rotation of the third interchangeable knob from the first marking of the 180° Group to the second marking of the 180° Group with respect to the reference marking on the support mechanism 10 correspondingly rotates the rotatable objects 180° on the support mechanism 10. The markings for the 120° Group include three markings appropriately identified on the third interchangeable knob such that a first rotation of the third interchangeable knob from the first marking of the 120° Group to the second marking of the 120° Group with respect to the reference marking on the support mechanism 10 correspondingly rotates the rotatable objects a 120° on the support mechanism 10. Similarly, a second rotation of the third interchangeable knob from the second marking of the 120° Group to the third marking of the 120° Group with respect to the reference marking on the support mechanism 10 correspondingly rotates the rotatable objects another 120° on the support mechanism 10. In this second variant of the second embodiment, the respective markings of the different angular displacement groups can be color-coded to more easily distinguish among the different angular displacement groups on the same interchangeable knob.

The rotational control mechanism 42 in a third embodiment further includes a slide handle fixedly attached to the timing belt for movement of the timing belt in a slide direction of the slide handle and a plurality of third template backgrounds respectively configured to be positioned proximate to the slide handle. The third template backgrounds each correspond to a respective common diameter of the plurality of rotatable objects to be processed and have markings that correspond to a plurality of angular displacement groups.

In one example, the third template background is configured for a plurality of one-inch diameter rotatable objects and includes markings for two angular rotation groups: the 180° Group and the 120° Group. The markings for the 180° Group include two markings appropriately identified on the third template background such that a sliding translation of a reference marking on the slide handle from the first marking of the 180° Group to the second marking of the 180° Group correspondingly rotates the rotatable objects 180° on the support mechanism 10. The markings for the 120° Group include three markings appropriately identified on the third template background such that a first sliding translation of the reference point on the slide handle from the first marking of the 120° Group to the second marking of the 120° Group correspondingly rotates the rotatable objects 120° on the support mechanism 10. Similarly, a second sliding translation of the reference point on the slide handle from the second marking of the 120° Group to the third marking of the 120° Group correspondingly rotates the rotatable objects another 120° on the support mechanism 10. As illustrated in the example, N for each different angular displacement group is different.

The support mechanism 10 in various embodiments includes a variety of features to facilitate processing of the rotatable objects. In one embodiment, the support mechanism 10 has one or more of side supporting rails and a lid to protect the cylindrical members 15 from heavy objects or boxes set on the support mechanism 10. In a embodiment, the support mechanism 10 has shading plates configured to extend upward from some or all of the sides for educing the amount of UV light escaping the printer or dust, mist, or other byproducts collaterally formed during processing. In yet another embodiment, the support mechanism 10 has fans attached to the unit for expelling dust, mist, or other byproducts ducts and has filters to filter dust, mist, or other byproducts.

Figure 2:
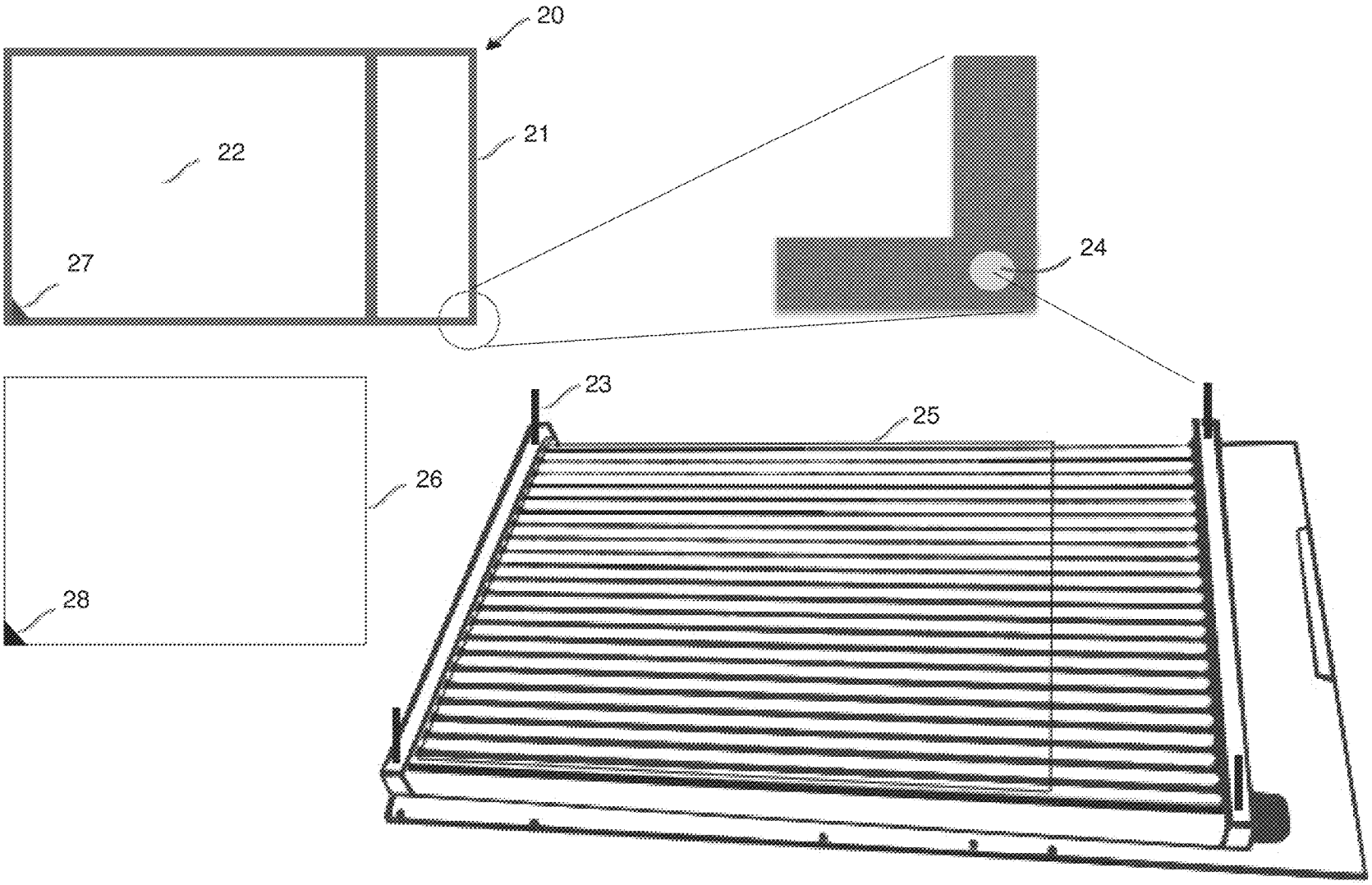
FIG. 2 shows a schematic top view of an alignment apparatus for aligning the plurality of rotatable objects on the support mechanism of FIG. 1.

FIG. 2 shows an alignment apparatus 20 of the positioning system. The alignment apparatus is configured to facilitate alignment of the plurality of rotatable objects on the cylindrical members 15 so as to enable alignment of the processing machine to the objects to be quick, easy, and well within the precision limits commonly needed in such applications. The alignment apparatus 20 includes a frame 21 configured to hold a transparent support screen 22 above the support mechanism 10. In the embodiment shown, the transparent support screen 22 is a planar, transparent support screen. The frame 21 is further configured to cooperate with the base plate 11 such that the transparent support screen 22 is positionable in spaced opposition to the cylindrical members 15 by any one or more of a variety of structures, including hinged or otherwise retractable legs, racks, blocks, interlocking tabs, grids or trays.

In one embodiment, the alignment apparatus 20 cooperates with a plurality of telescoping legs 23 that are extendable from the support mechanism 10 to support the alignment apparatus 20 at various heights. A top portion of the telescoping legs 23 are inserted into corresponding holes 24 in the alignment apparatus 20. Both the top portions of the telescoping legs 23 and the holes 24 can be tapered to facilitate insertion therebetween. The telescoping legs 23 can be located in a roughly rectangular, yet non-symmetrical formation, such that the alignment apparatus 20 is in engagement only in the correct position to align the transparent support screen 22 with a processing area 25 of the processing machine. The support screen 22 is sized to approximate the dimensions of the processing area, allowing the operator a visual frame of reference to check that the objects fit and are correctly positioned within the processing area 25.

A single, thin, loose transparency 26, which is precut to the size and shape of the processing area 25, is placed on the support screen 22. In a printing application, the loose transparency 26 can be pre-printed with the artwork that will be printed on the objects. In some embodiments, the transparency includes respective images that correspond to the expected positions of the plurality of rotatable objects on the cylindrical members 15. The images on the transparency in some embodiments are the artwork or other markings that are to be applied to the objects via the processing machine. The images on the transparency in other embodiments are outlines of the art work, such as the peripheral boundaries of the artwork, to facilitate placement of the objects on the cylindrical members 15. The support screen 22 includes a corner bridge and the loose transparency 26 includes a corresponding dog ear cut out 28 so as to enable a one-way fit and ensure correct placement in all future alignment checks for the specified object type.

The alignment apparatus 20 is configured to be pressed downward by the operator, thereby collapsing the telescoping legs 23 until the loose transparency 26 and the transparent support screen 22 are sufficiently close to the objects to allow the operator to visually inspect from directly above and confirm accuracy of the artwork positions to be printed on the objects. Once positioning is confirmed, the alignment apparatus 20 is removed, the telescoping legs 23 are collapsed completely, the loose transparency 26 is filed or stored, and the objects are processed.

Figure 6:
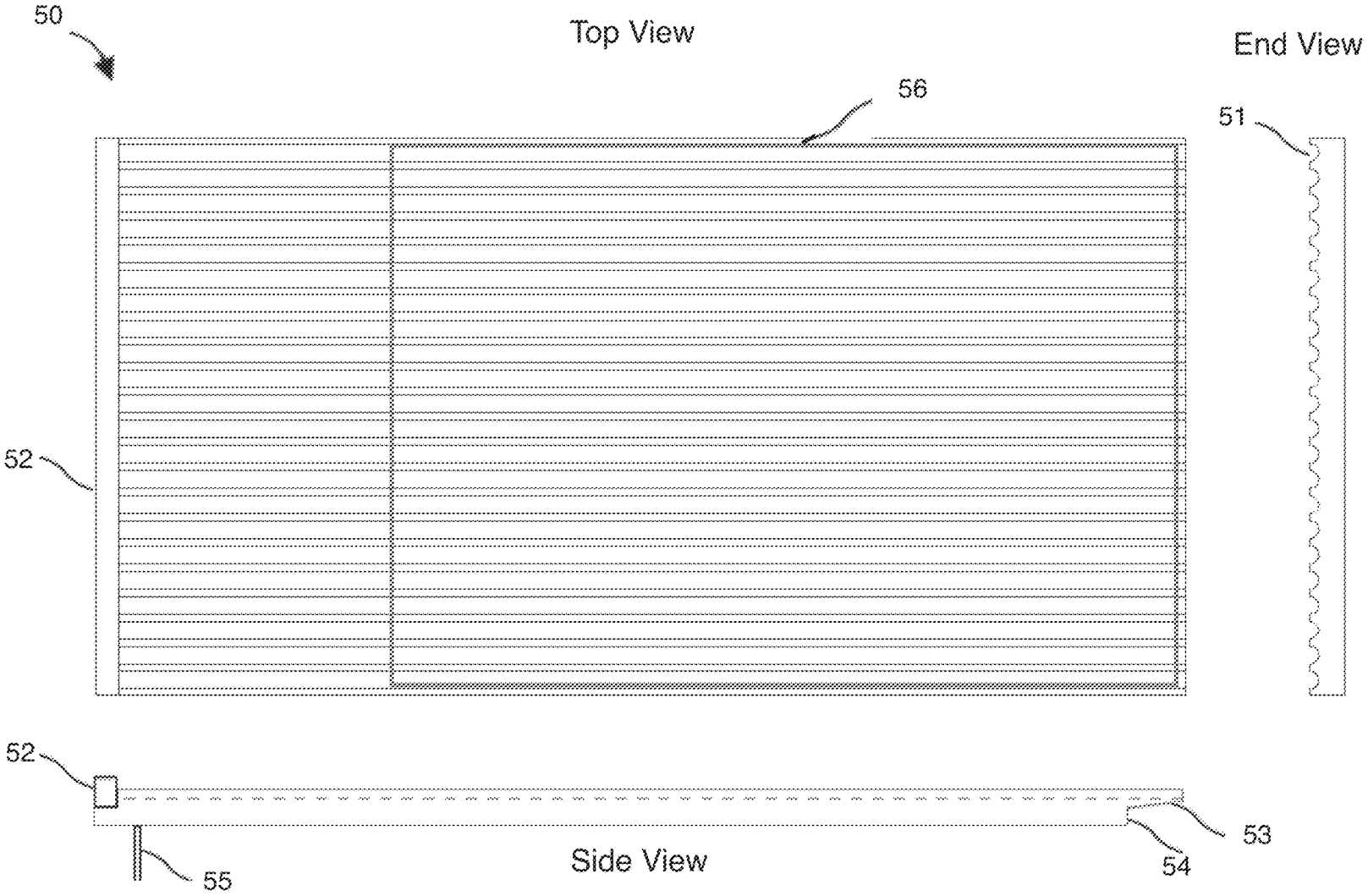
FIG. 6 shows top, side, and end views of a loading device that cooperates with the support mechanism of FIG. 1 to facilitate an alignment-controlled transfer of the plurality of rotatable objects from the loading device to the support mechanism.

FIG. 6 depicts a loading device 50 of the positioning system. The loading device 50 is configured to be loaded with a second group of rotatable objects while the processing machine is processing a first group of rotatable objects. In the embodiment shown, the loading device 50 has a body with a length that at least equals the axial length of the cylindrical members 15 or is longer than the cylindrical members 15. The body of the loading device 50 defines a plurality of parallel troughs or grooves 51 configured to align the second group of rotatable objects in the manner the objects are to be placed on the support mechanism 10. The loading device 50 includes a rear bumper 52 that facilitates loading of the objects on the loading device by providing a stop to slide the objects against. The loading device 50 has a front under edge that has a tapered thickness 53 so as to more closely meet the support mechanism 10 at the point of transfer when the objects are transferred from the loading device 50 to the support mechanism 10. The tapered thickness 53 extends to a lip 54 that engages against a back portion of the second block 17 of the support mechanism 10 so as to stabilize and hold the loading device 50 in an optimum position during loading.

When the first group of rotable objects is removed from the support mechanism 10 after processing, and the loading device 50 has been loaded with the second group of rotatable objects, the second group of rotatable objects is ready for transfer. To transfer the second group of rotatable objects to the support mechanism 10, the operator places the lip 54 of the loading device 50 on the second block 17 for support and stabilization, visually aligns the rows of objects on the loading device 50 with the position lines 61 of the support mechanism 10, tips up a back of the loading device 50, and uses a ruler or similar elongate device to sweep the objects simultaneously down from the loading device 50 onto the support mechanism 10. In addition to the grooves 51, the loading device 50 can include slots, side rails, or any other structural attributes that enhance the efficiency of proper alignment to the support mechanism 10. A processing area 56 can be marked on the loading device 50 to further aid in correctly positioning the objects.

Figure 7:
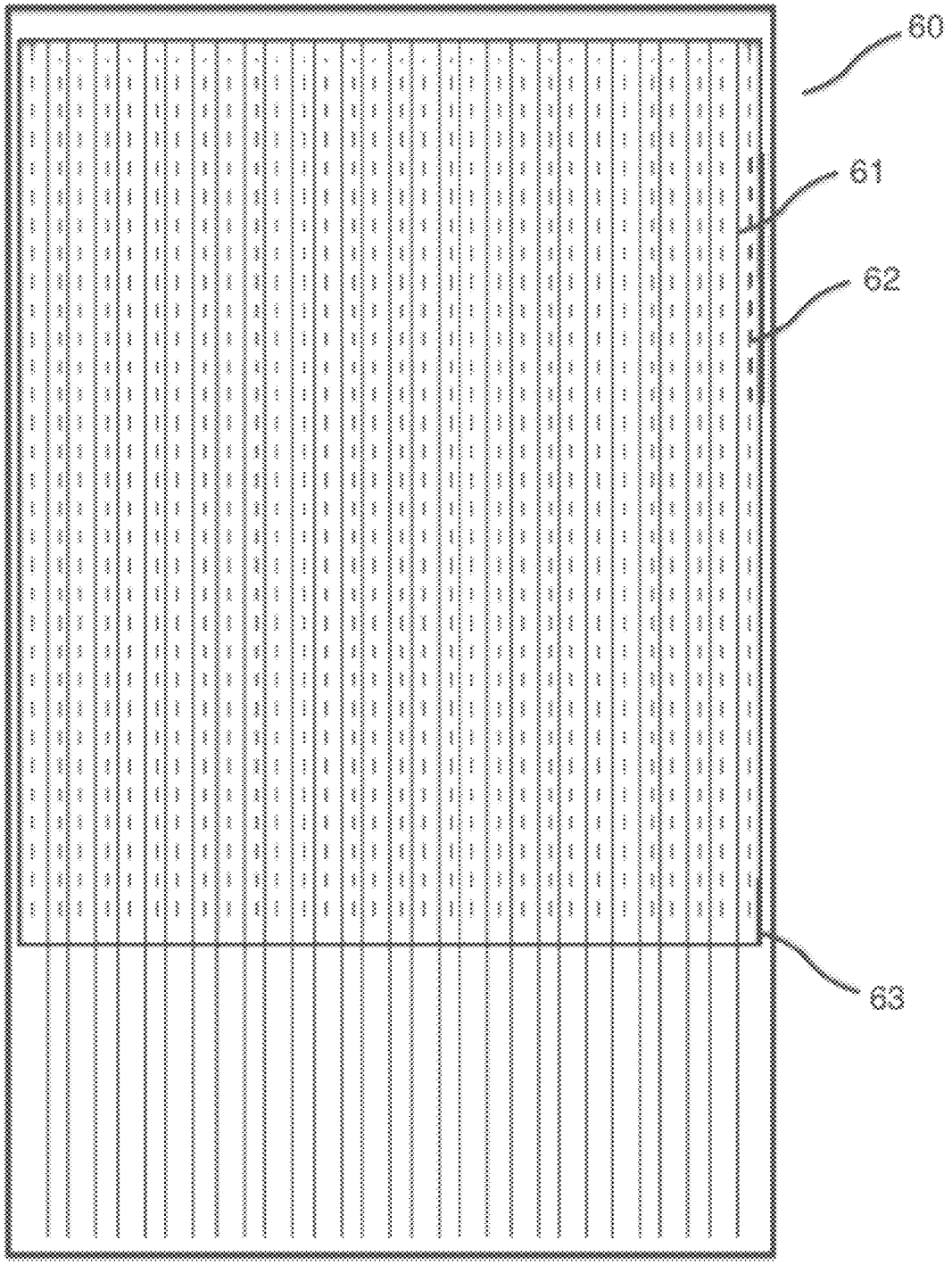
FIG. 7 depicts a placement pattern generated on a printer software template for determining placement of the plurality of rotatable members on the support mechanism of FIG. 1.

FIG. 7 shows a software template 60 of a placement pattern for placement of the plurality of rotatable objects on the support mechanism 10. The objects are initially arranged on the support mechanism 10 in the most efficient desired pattern. The arranged objects are then photographed for future reference and the placement pattern is built the software template 60. As shown in FIG. 7, the software template 60 displays the position lines 61 between the plurality of cylindrical members 15, which may be displayed in the background in a different color, a lighter shade, or dotted or dashed lines as shown in FIG. 7.

Thus, when objects are placed in alignment on the support mechanism 10, the respective center axes of the placed objects will automatically be centered with the position lines 61 shown in the software template 60. The template in some embodiments displays a representation of the entire support mechanism 10, or in other embodiments, the template displays only the processing area (outlined as rectangle 63 in FIG. 7). In a printing application, artwork can then be placed along the parallel position lines 61 to form the pattern to be used for processing all of the objects on the support mechanism 10.

The loose transparency 26 of FIG. 2 can then be placed on the fixture and processed, for example with the artwork, preferably with objects already placed under the transparency 26 on the support mechanism 10, provided such an arrangement leaves enough clearance under the gantry of the processing machine. A visual alignment check is then completed, making sure the transparency 26 is sufficiently near the objects to be processed. After alignment is visually confirmed, the frame is removed, the telescoping legs 23 are closed, and the objects are processed. The loose transparency 26 is stored for future use when the corresponding objects are to be printed again.

As noted above with reference to FIG. 1, spherical or round objects such as golf balls, super balls, or table tennis balls can be placed on the support mechanism 10 to be processed though such spherical or round objects may need to be secured from rolling along the cylindrical members 15.

In one embodiment, at least one blocking object is placed on the end of the support mechanism 10 such that spherical objects resting on the cylindrical members 15 are held securely in position. The blocking object in one embodiment is configured to secure the spherical objects to be processed, but not so tightly that the spherical objects will not rotate on the support mechanism 10. The blocking object in one embodiment is a single-piece bridge that traverses the entire support mechanism 10 and attaches onto side rails to be secured in place at any desired position relative to the cylindrical members 15. The blocking object in another embodiment includes one or more cylinders configured to rotate along with the spherical objects to be processed.

Figure 8:
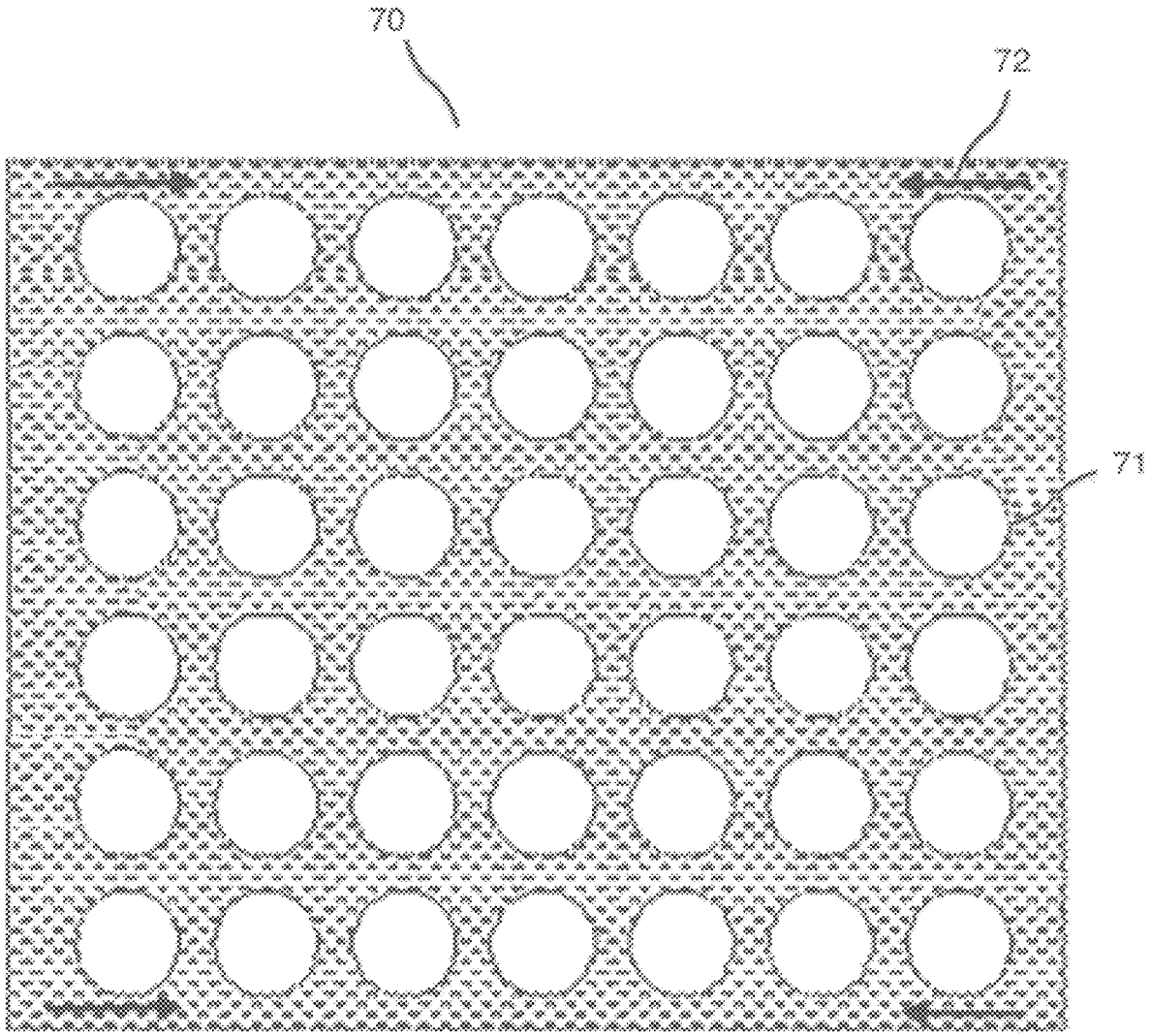
FIG. 8 shows a top view of a fixture plate disposed above the support mechanism of FIG. 1 for aligning a plurality of spherical objects on the cylindrical members via cutouts in the fixture plate.

FIG. 8 shows an embodiment of a fixture plate 70 configured to facilitate processing of spherical objects. The fixture plate 70 defines a plurality of circular cut-outs 71 and is positioned above the support 10 at a height conducive for retaining the spherical objects on the support mechanism 10 during processing. The circular cut-outs 71 in the fixture plate 70 are configured to prevent the spheres from moving out of position along the cylindrical members 15 during processing. The fixture plate 70 extends to contact the telescoping legs 23 (FIG. 2) for support, alignment, and to optimize the height position of the fixture plate so as to avoid impeding the rotation of the spherical objects, but also to prevent the spherical objects from rolling out of position.

In another embodiment, the fixture plate 70 is slightly raised to tightly secure the position of the spherical objects, slightly lowered just before rotating the spheres, then slightly raised again to secure the new position. This positional variance is accomplished using the telescoping legs 23 or by using any of several other position adjusting features. In another embodiment, the fixture plate 70 has hinged legs 72 that are set in a slight depression in the base plate 11, which is the lowered position for turning the spherical objects. The hinged legs 72 in this embodiment are then moved out of the slight depression, thereby raising the fixture plate to the raised position for processing. In another embodiment, the fixture plate has two sets of legs: one set for the lowered position and one set for the raised position. The first set of legs in this embodiment can be attached in a fixed position at a height configured to secure the spherical objects in a loose manner conducive for turning. The second, longer set of legs can be hinged or otherwise retractable and put into position when the spherical objects are ready to be processed.

Figure 9:
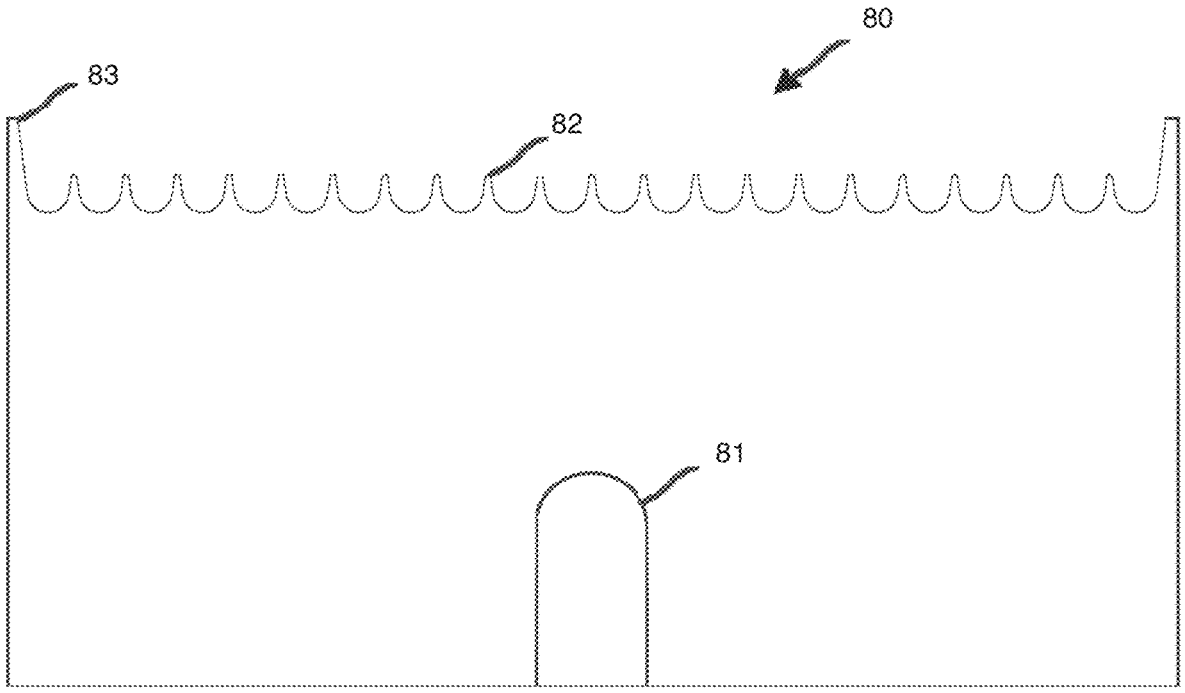
FIG. 9 shows a top view of an unloading device that cooperates with the plurality of rotatable objects and the support mechanism of FIG. 1 to provide efficient removal of the rotatable objects from the support mechanism.

FIG. 9 shows a top view of an unloading device 80 of the positioning system. The unloading device 80, also referred to as a scoop, is configured to efficiently remove the rotatable objects from the supporting mechanism 10 of FIG. 1 preferably in one pass of the unloading device. The unloading device 80 includes a handle 81 for hand-manipulation of the unloading device by the operator. The unloading device 80 further includes teeth 82 that are configured to extend between adjacent cylindrical members 15 of the plurality of cylindrical members 15 and cooperate with the rotatable objects to remove the objects from the support mechanism 10. To remove the objects with the unloading device 80, the operator inserts the unloading device 80 with the teeth 82 positioned between the cylindrical members 15 at such an angle to wedge the objects into the unloading device as the unloading device is moved along the support mechanism 10.

Figure 10:
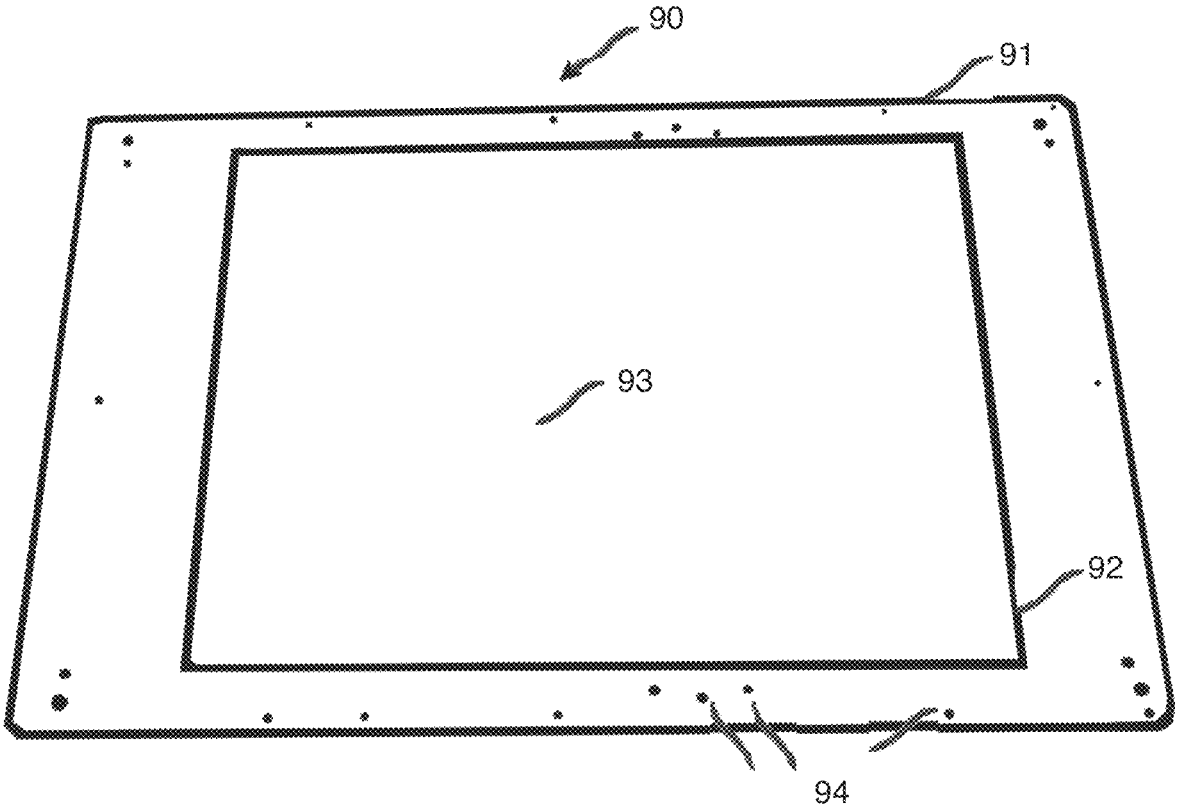
FIG. 10 shows a top perspective view of one embodiment of a support mechanism for positioning a plurality of non-rotatable objects via a fixture pad.

FIG. 10 depicts a positioning system with an exemplary support mechanism 90 configured to position and releasably secure a plurality of non-rotatable objects for processing. The term "non-rotatable objects" includes any object that is not a "rotatable object" as defined above. The support mechanism 90 of FIG. 10, also referred to as a fixture pad, includes a base plate 91 configured to be positioned on a support surface 12 (FIG. 1) of a processing machine. In some embodiments, the base plate 91 is the same as the base plate 11 of FIG. 1, but the base plate 91 does not include the cylindrical members 15 or the first and second blocks 16, 17. The base plate 91 has an object support surface and defines alignment holes 94 for aligning the base plate 91 on the support surface 12 of the processing machine. The object support surface includes a marking 92 that delineates a processing area of the processing machine in ink or another material.

The support mechanism further includes an adhesive pad or coating 93 disposed on the object support surface so as to cover the entire processing area. The adhesive pad 93 has an adhesive strength configured to retain the plurality of non-rotatable objects for processing and release of the plurality of non-rotatable objects for removal or reorientation after processing. The adhesive pad 93 in some embodiments is made of a low-tack adhesive that is soft so as to increase the ability adhesive pad to hold the non-rotatable objects in position. The adhesive pad 93 in other embodiments has a long tack life and is washable for regeneration of the tackiness of the coating via a regeneration process. In yet another embodiment, the adhesive pad 93 is a sheet, which is tacky on two sides and can be replaced with a fresh sheet when needed.

In yet another embodiment, the adhesive pad 93 is configured as an adhesive coating disposed in one or more layers directly on the base plate and used to adhere a sheet that has only one tacky side, which faces towards the objects to be held in position. The single tack sheet in this embodiment is replaced with a fresh tack sheet when needed. The adhesive pad 93 in other embodiments is soft, cushioned, or easily indented to aid in positioning and holding objects thereon. As such, the adhesive pad 93 in some embodiments does not include adhesive, but instead consists of a foam, gel, or other material conducive for retaining objects temporarily in a fixed position without adhesives. The alignment apparatus 20 of FIG. 2 is used in conjunction with the support mechanism 90 of FIG. 10 in some embodiments for the operator to visually place and correctly position the objects on the adhesive pad 93 in the manner described above with reference to FIG. 2. In yet another embodiment, the base plate 91 of FIG. 10 is placed on the support mechanism 10 of FIG. 1 and registered to the telescoping legs 23 (FIG. 2), which are used as supports for the alignment apparatus 20 (FIG. 2).

Figure 11:
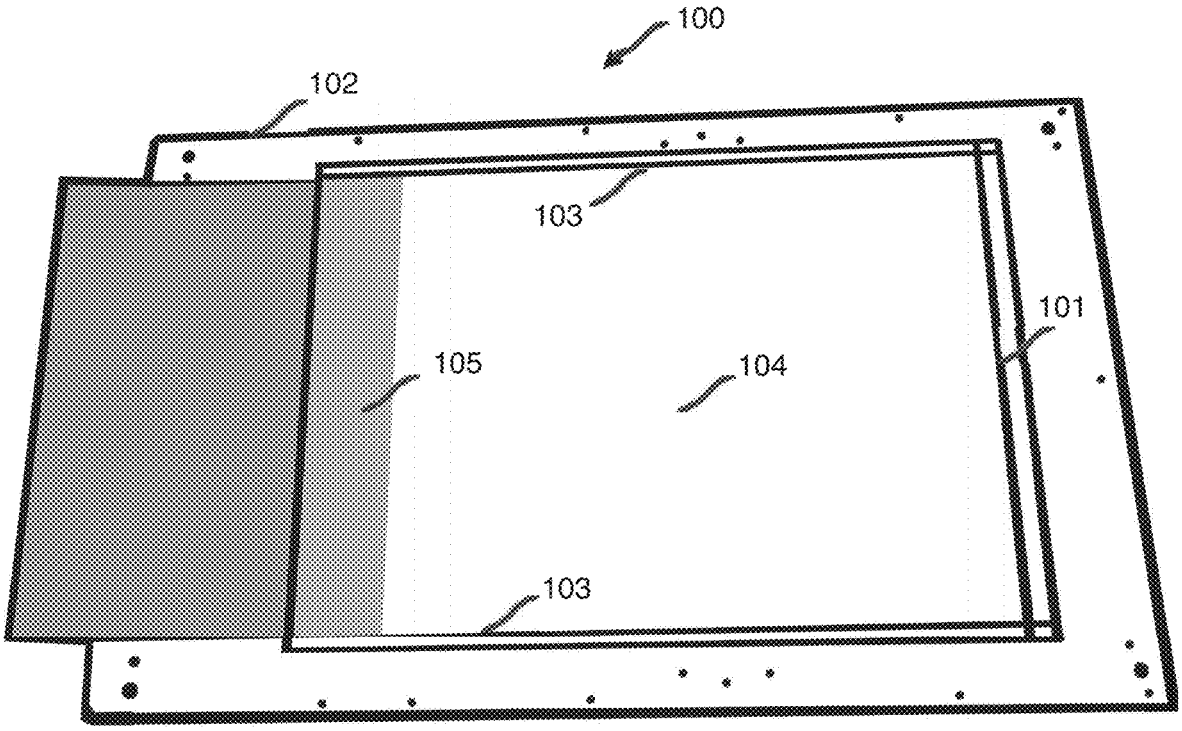
FIG. 11 shows a top perspective view of another embodiment of a support mechanism for positioning a plurality of non-rotatable objects via a translucent fixture pad.

FIG. 11 depicts a positioning system with another support mechanism 100 configured to position and releasably secure the plurality of non-rotatable objects for processing. The support mechanism 100 of FIG. 11, also referred to as a fixture pad, includes a base plate 102 configured to be positioned on the support surface 12 (FIG. 1) of a processing machine. A tray plate 101 is made of a transparent material, such as tempered glass, and supported slightly above the base plate 102 by slot rails 103. The adhesive pad 104 is also clear or transparent, thereby allowing the operator to see through to a pattern pre-printed on a pattern sheet 105, which slides into position underneath the adhesive pad 104. The pattern sheet 105 in the embodiment shown is the transparency 26 of FIG. 2, although in other embodiments the pattern sheet 105 can be paper or another opaque material. Guided by the slot rails 103, the pattern sheet 105 slides under the tray plate 101 to allow visual alignment of objects to be processed, and can be replaced with another pattern sheet 105 when changing to a different job. Visibility through the adhesive pad 104 need not be perfect, as the intended purpose is simple placement of items in the proper location. Thus, images on the pattern sheet 105 can be thick, high-contrast printed outlines so as to be sufficiently visible through the adhesive pad 104. The adhesive pad 104 of FIG. 11 in some embodiments is made of any of the same components as the adhesive pad 93 of FIG. 10 so long as the adhesive pad 104 is sufficiently transparent.

If the pattern sheet 105 is a transparency or a paper sheet that is sufficiently transparent, the pattern sheet 105 can be prepared by placing it on the alignment apparatus 20 of FIG. 2 and then printing the artwork directly on the pattern sheet 105. Next, the objects to be processed are placed under the pre-printed pattern sheet 105 (transparency), preferably on the tray plate 101 and viewed from directly above to visually check that the objects are properly positioned in alignment with the artwork printed on the pattern sheet 105. To facilitate the visual check, the frame 21 of FIG. 2 is pushed down, collapsing the telescoping legs 23 until the pattern sheet 105 is very close to the objects. Next, a dark marker or the like is used to trace the outline of the objects on the pattern sheet 105 for use in future alignment of additional batches of objects, by sliding the pattern sheet 105 under the tray plate 101, as described above. To enhance contrast of the traced outlines, a white or light colored paper or other material can be used as backing for the pattern sheet 105.

In other embodiments, the support mechanism 90 of FIG. 10 and the support mechanism 100 of FIG. 11 are printed along each edge with a ruler. The ruler can be metric along one side and one end and be SAE along the opposite side and opposite end. The metric and SAE rulers can be printed in different colors and have grid lines extending across the entire support mechanism as a further aid in aligning and positioning objects thereon.

In another embodiment, before or after a first batch of objects has been placed on the support mechanism, a plurality of thin alignment rails, at least the length of the adhesive pad, can be placed adjacent to respective columns of the objects as a further aid in placement of objects of any subsequent batches. The alignment rails are held in place by the adhesive pad and can include rails of various heights to select for use with various objects. Additional rails can also be placed adjacent to each row of the items, perpendicular to the column rails. The row rails may sit above the column rails, having feet that protrude down at each end to contact the adhesive pad to hold them in place. The row rails can be further held in place using Velcro or another releasable adhesive along the tops of each column rail and the bottom of each row rail. Small blocks can be used instead of the row rails in various embodiments by placing the blocks on the adhesive pad, adjacent to each column rail and adjacent to the top or bottom of each item, to frame the corner of each object.

In another embodiment, before or after a first batch of objects has been placed on the support mechanism, a plurality of L brackets can be placed on the adhesive pad adjacent to each item for the purpose of framing the items as a further aid in placement of objects of any subsequent batches.

Figure 12A:
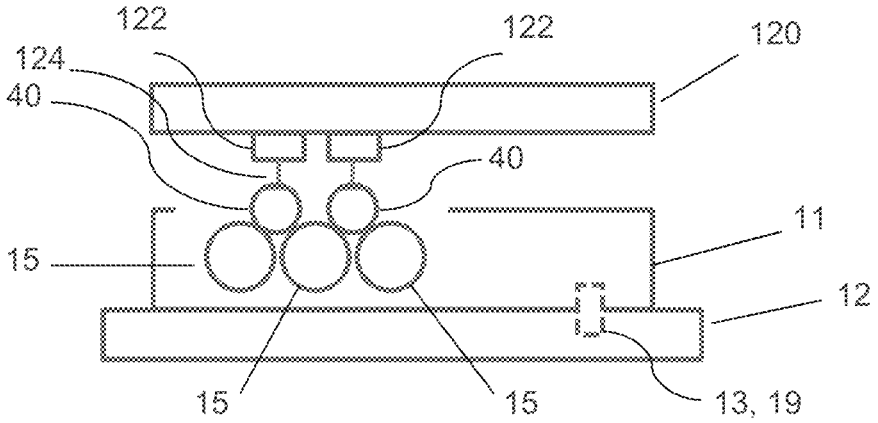
FIGS. 12A-12D depict a simplified representation of the support mechanism of FIG. 1 disposed in a printer with two rotatable objects positioned by the support mechanism to receive print media on at least two different sides of the objects.

FIGS. 12A-12D depict a simplified representation of the support mechanism 10 of FIG. 1 implemented in a printing process. With reference to FIG. 12A, the base plate 11 is positioned on the support surface 12 of a printer 120. The alignment member 13 of the printer corresponds to the alignment member 19 of the support surface for proper alignment of the base plate 11 to the printer 120. The base plate 11 is shown partially fragmented so that the cylindrical members 15 of the support mechanism 10 are visible. In the example shown, three cylindrical members 15 of the support mechanism 10 are shown supporting two rotatable objects 40 for processing. The printer 120 in the example shown has two print heads 122 configured to dispense print media 124 onto a portion of the circumferential surface of the rotatable objects 40 positioned below each print head 122. As shown in FIG. 12A, the cylindrical members 15 rotatably position the rotatable objects 40 to receive a first application of print media 124 on first circumferential portions of the rotatable objects 40.

Figure 12B:
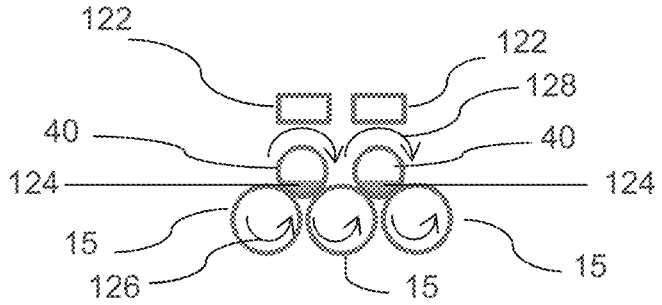
Figure 12C:
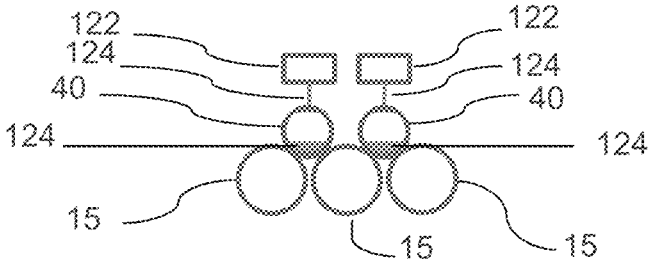
Figure 12D:
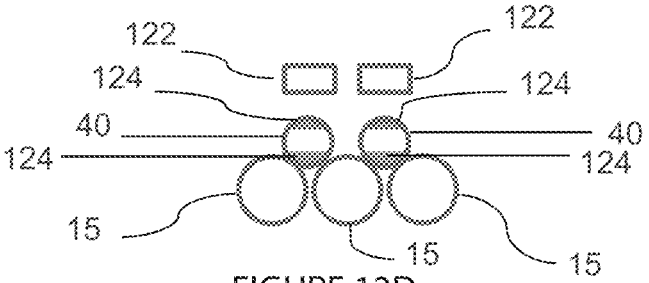

FIGS. 12B-12D depict the simplified representation of FIG. 12A further simplified showing only the cylindrical members 15, the rotatable objects 40, the print heads 122, and the print media 124. With reference to FIG. 12B, after the print heads 122 dispense the print media 124 onto the first circumferential portions of the rotatable objects (FIG. 12A), the cylindrical members 15 are rotated in synchrony over a predetermined angular displacement in order to rotate the rotable objects 40 over a predetermined angular displacement. The synchronous counterclockwise rotation of the cylindrical members 15 as depicted by arrow 126 synchronously rotates the rotatable objects 40 in a clockwise direction as depicted by arrow 128. In the example shown in FIG. 12B, the rotatable objects 40 have been rotated 180° so that the first circumferential portions with print media 124 now face 180° away from the print heads 122 and second circumferential portions of the rotatable objects 40, which possess no print media 124, are now disposed directly below the print heads 122. FIG. 12C depicts a second application of print media 124 on the second circumferential portions of the rotatable objects 40. FIG. 12D shows the print media 124 on the first and second circumferential portions of the rotatable objects 40 after the print process.

Figure 13:
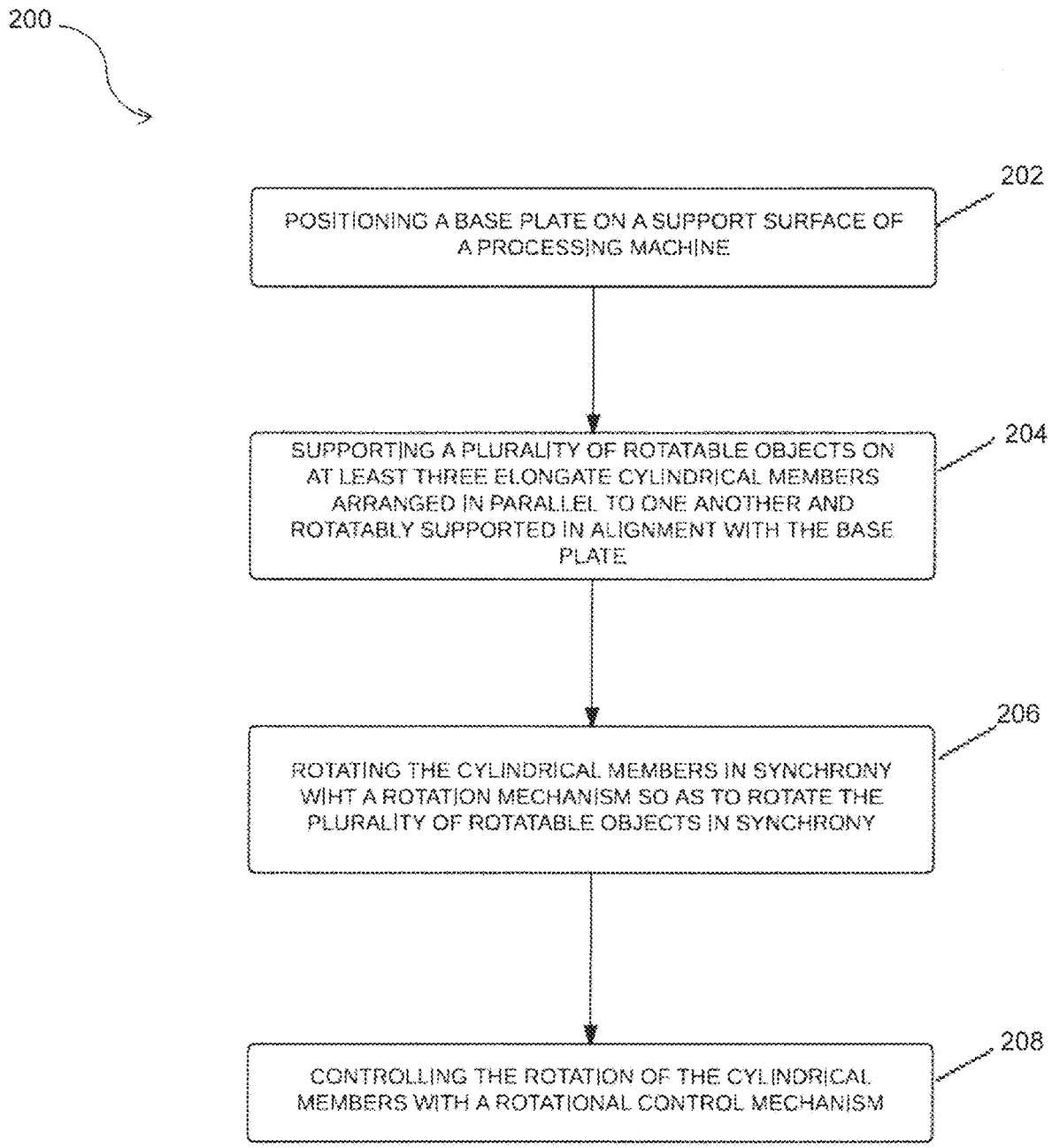
FIG. 13 is a flow diagram of a method for operating the support mechanism of FIG. 1 to position the plurality of rotatable objects for multi-sided processing.

A flow diagram of a method 200 for operating a positioning system is shown in FIG. 13. The method is described with reference to the support mechanism 10 of the positioning system shown in FIGS. 1 and 3. An operator implements the method 200 by positioning the base plate 11 of the support mechanism 10 on a support surface 12 of a processing machine (block 202). The base plate 11 is aligned to the support surface 12 in one embodiment by aligning the alignment members 13 of the base plate 11 to the alignment members 19 of the support surface 12 and then fixing the base plate 11 to the support surface 12 via cooperation of the respective alignment members 13, 19. The operator then places a plurality of rotatable objects 40 on at least three elongate cylindrical members 15, which are arranged in parallel to one another and rotatably supported in alignment with the base plate 11 (block 204).

Once the rotatable objects 40 are supported on the cylindrical members 15 (block 204), the rotatable objects 40 are processed on one side with the processing machine. After the rotatable objects 40 are processed on one side, the cylindrical members 15 are rotated in synchrony with a rotation mechanism 30 so as to rotate the plurality of rotatable objects 40 in synchrony (block 206). The operator controls the rotation of the cylindrical members 15 via a rotational control mechanism 42 (block 208). The rotational control mechanism 42 enables the operator to rotate all of the rotatable objects 40 in synchrony over a predetermined angular displacement for efficient and precise multi-sided processing of the rotatable objects 40.

The foregoing detailed description of one or more embodiments of the positioning system and alignment apparatus has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

The invention claimed is:

1. A positioning system for positioning a plurality of rotatable objects, comprising:

a base plate configured to be positioned on a support surface of a processing machine, the base plate defining a plurality of alignment members for aligning the base plate to the support surface;

at least three elongate cylindrical members arranged in parallel to one another and rotatably supported in alignment with the base plate, the cylindrical members configured to support the plurality of rotatable objects, the at least three elongate cylindrical members including a first pair of adjacent cylindrical members and a second pair of adjacent cylindrical members, wherein the first pair of adjacent cylindrical members is configured to support first rotatable objects of the plurality of rotatable objects and to align the first rotatable objects along a first position line extending axially between the first pair of adjacent cylindrical members, and wherein the second pair of adjacent cylindrical members configured to support second rotatable objects of the plurality of rotatable objects and to align the second rotatable objects along a second position line extending axially between the second pair of adjacent cylindrical members;

a rotation mechanism configured to cooperate with the cylindrical members and rotate the cylindrical members in synchrony so as to rotate the plurality of rotatable objects in synchrony; and a rotational control mechanism configured to cooperate with the rotation mechanism to control rotation of the cylindrical members.

2. The positioning system of claim 1, wherein the rotation mechanism includes:

a timing belt with a plurality of protrusions spaced apart along a periphery of the timing belt, and a respective timing pulley fixedly attached to an end of each cylindrical member, each timing pulley having a plurality of grooves spaced apart along an outer periphery of the timing pulley, wherein the protrusions of the timing belt are configured to cooperate with the grooves of the respective timing pulleys so that movement of one or more of the timing belt and any one or more of the timing pulleys rotates the cylindrical members in synchrony.

3. A positioning system for positioning a plurality of rotatable objects, comprising:

a base plate configured to be positioned on a support surface of a processing machine, the base plate defining a plurality of alignment members for aligning the base plate to the support surface;

at least three elongate cylindrical members arranged in parallel to one another and rotatably supported in alignment with the base plate, the cylindrical members configured to support the plurality of rotatable objects;

a rotation mechanism configured to cooperate with the cylindrical members and rotate the cylindrical members in synchrony so as to rotate the plurality of rotatable objects in synchrony;

a rotational control mechanism configured to cooperate with the rotation mechanism to control rotation of the cylindrical members;

a first block arranged on the base plate; and a second block arranged on the base plate and spaced apart from the first block, the first and second blocks configured to rotatably support the cylindrical members and align the cylindrical members with the base plate, wherein the rotation mechanism is arranged in a channel defined in the second block.

4. The positioning system of claim 2, wherein the rotational control mechanism includes:

a shaft rotatably supported with respect to the base plate, and a drive pulley fixedly attached to the shaft and configured to cooperate with the timing belt to move the timing belt relative to the timing pulleys when the shaft is rotated.

5. The positioning system of claim 4, wherein:

the rotational control mechanism further includes a knob configured to be attached to the shaft so as to rotate the shaft when the knob is rotated, and at least one of the plurality of rotatable objects includes one or more markings indicative of a predetermined angular displacement of the plurality of rotatable objects.

6. A positioning system for positioning a plurality of rotatable objects, comprising:

a base plate configured to be positioned on a support surface of a processing machine, the base plate defining a plurality of alignment members for aligning the base plate to the support surface;

at least three elongate cylindrical members arranged in parallel to one another and rotatably supported in alignment with the base plate, the cylindrical members configured to support the plurality of rotatable objects;

a rotation mechanism configured to cooperate with the cylindrical members and rotate the cylindrical members in synchrony so as to rotate the plurality of rotatable objects in synchrony;

a rotational control mechanism configured to cooperate with the rotation mechanism to control rotation of the cylindrical members, wherein:

the rotational control mechanism further includes (i) a knob configured to be attached to the shaft so as to rotate the shaft when the knob is rotated and (ii) a plurality of template backgrounds respectively configured to be positioned proximate to the knob, each template background (i) corresponds to a common diameter of the plurality of rotatable objects and (ii) has markings that correspond to a plurality of angular displacement groups, each angular displacement group includes a group of N markings indicative of equal angular displacements and N for each of the angular displacement groups is different, and the knob includes at least one reference marking such that successive rotations of the reference marking of the knob between the markings associated with one of the plurality of angular displacement groups rotates the rotatable objects between predetermined angular displacements.

7. The positioning system of claim 4, wherein:

the rotational control mechanism includes a plurality of interchangeable knobs configured to be attached, respectively, to the shaft so as to rotate the shaft when the knob is rotated, each knob (i) corresponds to a common diameter of the plurality of rotatable objects and (ii) has markings corresponding to a single angular displacement group that includes a group of N markings indicative of equal angular displacements and N for each of the angular displacement groups associated with the respective knobs is different, and the base plate includes at least one reference marking such that successive rotations of the knob attached to the shaft between the markings associated with the single angular displacement group rotates the rotatable objects between predetermined angular displacements.

8. The positioning system of claim 4, wherein:

the rotational control mechanism includes a plurality of interchangeable knobs configured to be attached, respectively, to the shaft so as to rotate the shaft when the knob is rotated, each knob (i) corresponds to a common diameter of the plurality of rotatable objects and (ii) has markings that correspond to a plurality of angular displacement groups, each angular displacement group includes a group of N markings indicative of equal angular displacements and N for each of the angular displacement groups is different, and the base plate includes at least one reference marking such that successive rotations of the knob attached to the shaft between the markings associated with one of the plurality of angular displacement groups rotates the rotatable objects between predetermined angular displacements.

9. The positioning system of claim 2, wherein:

the rotational control mechanism includes (i) a slide handle fixedly attached to the timing belt for movement of the timing belt in a slide direction of the slide handle and (ii) a plurality of template backgrounds respectively configured to be positioned proximate to the slide handle, each template background (i) corresponds to a common diameter of the plurality of rotatable objects and (ii) has markings that correspond to a plurality of angular displacement groups, each angular displacement group includes a group of N markings indicative of equal angular displacements and N for each of the angular displacement groups is different, and the slide handle includes at least one reference marking such that successive translations of the reference marking of the slide handle between the markings associated with one of the plurality of angular displacement groups rotates the rotatable objects between predetermined angular displacements.

10. The positioning system of claim 1, further comprising an alignment apparatus configured to facilitate alignment of the plurality of rotatable objects on the cylindrical members, the alignment apparatus including:

a frame configured to hold a transparent support screen, the frame configured to cooperate with the base plate such that the transparent support screen is positionable in spaced opposition to the cylindrical members, the support screen sized to approximate a processing area of the processing machine, and a sheet of transparent paper supported by the transparent support screen, the transparent paper sized to approximate the processing area and including respective images that correspond to expected positions of the plurality of rotatable objects on the cylindrical members.

11. A positioning system for positioning a plurality of rotatable objects, comprising:

a base plate configured to be positioned on a support surface of a processing machine, the base plate defining a plurality of alignment members for aligning the base plate to the support surface;

at least three elongate cylindrical members arranged in parallel to one another and rotatably supported in alignment with the base plate, the cylindrical members configured to support the plurality of rotatable objects;

a rotation mechanism configured to cooperate with the cylindrical members and rotate the cylindrical members in synchrony so as to rotate the plurality of rotatable objects in synchrony;

a rotational control mechanism configured to cooperate with the rotation mechanism to control rotation of the cylindrical members; and a loading device configured to load the plurality of rotatable objects onto the cylindrical members, the loading device including a body having a length that approximates an axial length of the cylindrical members, wherein the body defines a plurality of parallel grooves configured to align the plurality of rotatable objects with the grooves, and the grooves correspond, respectively, to position lines defined by adjacent cylindrical members such that alignment of the plurality of rotatable objects is maintained when the rotatable objects are transferred from the loading device to the cylindrical members.

12. The positioning system of claim 1, wherein the processing machine is a printer with at least one print head configured to dispense print media onto the plurality of rotatable objects.

13. An alignment apparatus for aligning of a plurality of objects on a support mechanism for processing, the support mechanism disposed on a support surface of a processing machine and configured to support and orient the plurality of objects, the support mechanism including a base plate that defines members for aligning the support mechanism on the support surface, the alignment apparatus comprising:

a frame configured to hold a transparent support screen, the frame configured to cooperate with the support mechanism such that the transparent support screen is positionable in spaced opposition to the support mechanism, the support screen sized to approximate a processing area of the processing machine; and a sheet of transparent paper supported by the transparent support screen, the transparent paper sized to approximate the processing area and including respective images that correspond to expected positions of the plurality of objects on the support mechanism.

14. The alignment apparatus of claim 13, further comprising a plurality of telescoping legs configured to cooperate with the support mechanism and vary the position of the alignment apparatus with respect to the support mechanism.

15. A method for positioning a plurality of rotatable objects for multi-sided processing, comprising:

positioning a base plate on a support surface of a processing machine, the base plate defining a plurality of alignment members for aligning the base plate to the support surface;

supporting the plurality of rotatable objects on at least three elongate cylindrical members arranged in parallel to one another and rotatably supported in alignment with the base plate, the at least three elongate cylindrical members including a first pair of adjacent cylindrical members and a second pair of adjacent cylindrical members, wherein the first pair of adjacent cylindrical members supports first rotatable objects of the plurality of rotatable objects and aligns the first rotatable objects along a first position line extending axially between the first pair of adjacent cylindrical members, and wherein the second pair of adjacent cylindrical members supports second rotatable objects of the plurality of rotatable objects and aligns the second rotatable objects along a second position line extending axially between the second pair of adjacent cylindrical members;

rotating the cylindrical members in synchrony with a rotation mechanism so as to rotate the plurality of rotatable objects in synchrony; and controlling the rotation of the cylindrical members with a rotational control mechanism.

16. The positioning system of claim 1, wherein the at least three elongate cylindrical members include at least four elongate cylindrical members that are equally spaced apart such that a distance between the first and second pairs of adjacent cylindrical members is equal to (i) a distance between the cylindrical members in the first pair of adjacent cylindrical members and (ii) a distance between the cylindrical members in the second pair of adjacent cylindrical members.

17. The positioning system of claim 3, the at least three elongate cylindrical members including a first pair of adjacent cylindrical members and a second pair of adjacent cylindrical members, wherein the first pair of adjacent cylindrical members is configured to support first rotatable objects of the plurality of rotatable objects and to align the first rotatable objects along a first position line extending axially between the first pair of adjacent cylindrical members, and wherein the second pair of adjacent cylindrical members configured to support second rotatable objects of the plurality of rotatable objects and to align the second rotatable objects along a second position line extending axially between the second pair of adjacent cylindrical members.

18. The positioning system of claim 6, the at least three elongate cylindrical members including a first pair of adjacent cylindrical members and a second pair of adjacent cylindrical members, wherein the first pair of adjacent cylindrical members is configured to support first rotatable objects of the plurality of rotatable objects and to align the first rotatable objects along a first position line extending axially between the first pair of adjacent cylindrical members, and wherein the second pair of adjacent cylindrical members configured to support second rotatable objects of the plurality of rotatable objects and to align the second rotatable objects along a second position line extending axially between the second pair of adjacent cylindrical members.

19. The positioning system of claim 11, the at least three elongate cylindrical members including a first pair of adjacent cylindrical members and a second pair of adjacent cylindrical members, wherein the first pair of adjacent cylindrical members is configured to support first rotatable objects of the plurality of rotatable objects and to align the first rotatable objects along a first position line extending axially between the first pair of adjacent cylindrical members, and wherein the second pair of adjacent cylindrical members configured to support second rotatable objects of the plurality of rotatable objects and to align the second rotatable objects along a second position line extending axially between the second pair of adjacent cylindrical members.

20. The method of claim 15 wherein the processing machine is a printer with at least one print head configured to dispense print media onto the plurality of rotatable objects, the method further comprising (i) printing on the plurality of rotatable objects with the at least one print head prior to rotating the cylindrical members in synchrony, and (ii) printing on the plurality of rotatable objects with the at least one print head after rotating the cylindrical members in synchrony.

21. The method of claim 20 wherein the at least three elongate cylindrical members are equally spaced apart.

* * * * *